United States Patent [19]

Robertson

[11] 4,208,051

[45] Jun. 17, 1980

[54] BASEBALL FIELDING TRAINING AID AND METHOD

[76] Inventor: Thomas S. Robertson, Rte. 2, Box 120-A, Jacksonville, Tex. 75766

[21] Appl. No.: 852,833

[22] Filed: Nov. 18, 1977

[51] Int. Cl.[2] ..... A63B 71/02

[52] U.S. Cl. ..... 273/26 C

[58] Field of Search ..... 273/26 C, 26 R, 97 R, 273/67 B, 30, 76; 2/19, 20, 16, 17, 158, 159, 160, 161 A, 161 R; 35/29 R

[56] References Cited

U.S. PATENT DOCUMENTS

| | | | |
|---|---|---|---|
| 454,700 | 6/1891 | Baker | 273/76 |
| 819,250 | 5/1906 | Paget | 273/67 B |
| 1,066,696 | 7/1913 | Baker | 273/67 B |
| 1,402,799 | 1/1922 | Ryan | 273/67 B |
| 1,558,666 | 10/1925 | Brewer et al. | 273/67 B |
| 2,142,068 | 12/1938 | Berger | 273/97 R |
| 2,228,586 | 1/1941 | Protzky | 273/67 B |
| 2,269,633 | 1/1942 | Merle | 273/97 R |
| 3,229,979 | 1/1966 | Smoak | 273/97 R |
| 4,121,824 | 10/1978 | Hirschfield | 273/26 C |

FOREIGN PATENT DOCUMENTS

| | | | |
|---|---|---|---|
| 444407 | 6/1927 | Fed. Rep. of Germany . | |
| 12632 | of 1890 | United Kingdom | 273/67 B |

*Primary Examiner*—Richard C. Pinkham
*Assistant Examiner*—T. Brown
*Attorney, Agent, or Firm*—James M. Pelton

[57] ABSTRACT

A method and apparatus for instructing baseball players in the proper manner of catching a ground ball. The player wears on his hand a rigid flat plate having the general outline of a baseball fielder's glove. When a ground ball strikes the plate, the fielder must use the proper two-handed fielding technique of trapping the ball with the throwing hand against the plate.

2 Claims, 5 Drawing Figures

BASEBALL FIELDING TRAINING AID AND METHOD

BACKGROUND OF THE INVENTION

This invention relates to a method and apparatus for teaching fielding to baseball players. Commonly, the only way to instruct a novice ball player in the art of fielding is to give him a baseball glove, basic instructions on position, throwing and then hit grounders to him while pointing out faults which occur during actual doing. So far as is known there has been no device or aid which an instructor can employ to require the acquisition of proper techniques on a player until my invention. Now my invention allows the instructor or coach to train baseball players to properly catch a ground ball hit to them by using a ball-stopping, glove-like device requiring the use of proper skills in order to catch the ball.

SUMMARY OF THE INVENTION

In accord with my invention, there is provided, an apparatus for training baseball players to catch a ball, such as a baseball or softball, hit on the ground which apparatus comprises a relatively thin, rigid, uniformly thick ball-impingement board generally having the outline of a baseball fielders' glove and having means for attachment to the player's or catcher's hand. As another aspect of my invention, there is provided a method of training baseball players to catch a ball hit on the ground by providing the player with the above device and hitting a ground ball generally in the direction of the player so that the device must be used to attempt to stop the ball, as with a glove, but also with the throwing hand grasping the ball to hold it on the surface of the fielders' training aid before it can be successfully caught and subsequently thrown.

DETAILED DESCRIPTION OF THE PREFERRED EMBODIMENTS

Figure 1:
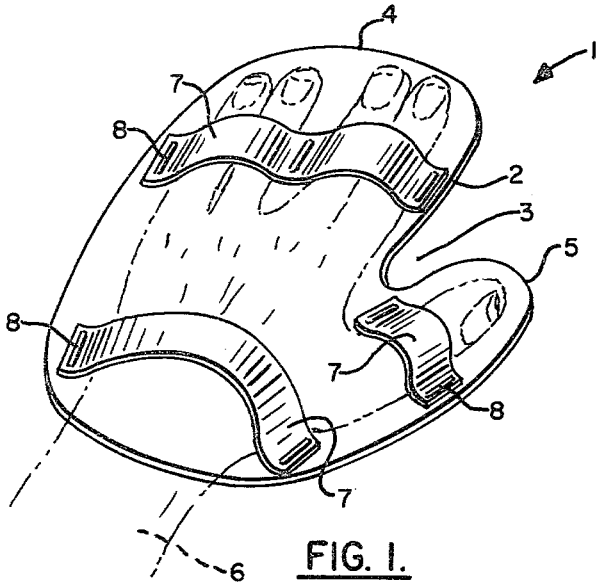
FIG. 1 shows the present invention having elastic bands affixed to the fielders' training aid for attaching to the hand.
Figure 3:
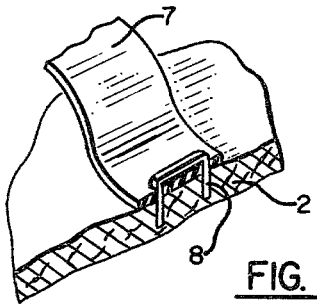
FIG. 3 is a partial sectional view showing in detail one method of attaching the elastic bands to the training aid.
Figure 4:
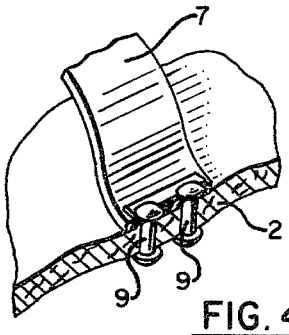
FIG. 4 also shows a partial sectional view of another method of attaching the elastic bands to the fielders' training aid.
Figure 2:
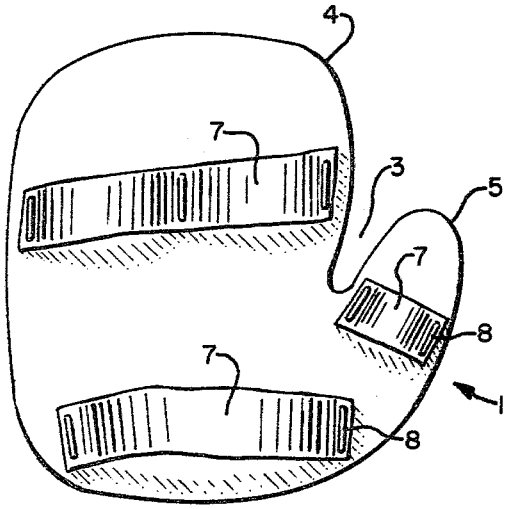
FIG. 2 is a back view showing the relative position of the attaching elastic bands.
Figure 5:
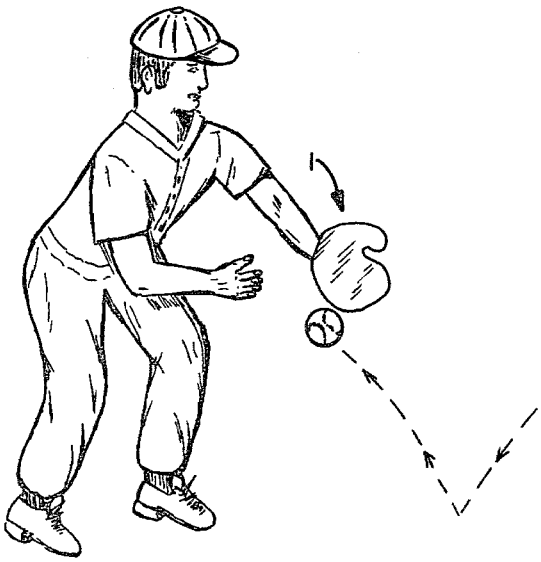
FIG. 5 is a pictorial view representing use of the apparatus of the present invention.

As shown in FIGS. 1 and 2, the apparatus of the present invention, generally designated as 1, has a flat, rigid ball-impingement surface 2 on one side and is generally in the outline of a baseball player's glove having an indentation 3 between the finger portion 4 and the thumb portion 5. The apparatus 1 is attached to the player's hand 6 by any suitable means, such as elastic bands 7 over the wrist, fingers and thumb. The elastic bands are securred to the back of the apparatus 1 by means of any conventional fastener which does not interfere with the provision of a smooth ball-impingement surface 2 on the "catching" side of the apparatus 1. For example, in FIGS. 1, 2 and 3, large staples 8 are illustrated as the attaching means. It should be noted, however, that other attaching means are useful, such as the rivets 9 of FIG. 4.

In use, my invention encourages good fielding habits by the positive reinforcement of successfully catching grounders and discourages bad fielding habits by resulting in missed catches when improper technique is employed. A regular baseball fielders' glove allows one hand to be used for catching grounders because of its soft and flexible nature, thus, developing bad fielding habits.

For example, in use, my invention requires proper positioning of the player squarely in front of the ball with the player poised on both feet and having both hands down. The players' body must squarely face the ball, by which is meant the axes of the shoulders and hips are preferably at right angles to the line of travel of the ball, to be able to anticipate an errant bounce on the ground. Players with regular baseball gloves tend to reach for the ball with one hand and without getting into the proper position because of the large flexible nature of the glove. By being flat and rigid, the present invention does not permit one-handed catching. Both hands must be used cooperatively with the hand having my apparatus attached used to stop the ball and the throwing hand trapping the ball against the ball-impingement surface.

This two-handed catch is necessary to prevent errors in transferring the ball from the glove to the throwing hand and to obtain a quick release of the ball from the glove for fast throws to a teammate.

Another bad habit developed by baseball players is a "high carry" of the glove allowing ground balls to slip underneath the glove. Using the fielders' aid apparatus of my invention, the ball must first strike the ball-impingement surface to stop the grounder. This requires careful hand-eye coordination until impact of ball on the ball-impingement surface, so that the high carry is avoided.

In many instances, just before the ball is caught, a player will look toward the place he wishes to throw the caught ball. However, by looking away at this critical instant an error can result. About 20 percent of fielding errors are caused by this factor. Using the present invention requires and reinforces looking at the ball until firmly trapped by both hands.

The present invention also requires that the instant the hit ground ball strikes the ball-impingement surface, the player must move the apparatus backward in the direction of travel of the ball. In other words, the rigid surface of my invention requires the player to "give" or yield somewhat so that the ball will not start immediately to bounce away before being grasped by the throwing hand. This "giving" prevents what is referred to as the bad habit of "hard hands" in which the player may let the ball bounce out of his glove before it can be closed. By learning to "give" in using the apparatus and method of my invention, the throwing hand has time to grasp and trap the ball before it bounces away.

The present invention can be used to teach good fielding habits to young players, reinforce positive habits in intermediate-stage players and break bad habits acquired by more advanced players. It can be used by all ages as a training device in learning to field a hit ground baseball.

Having described my invention, one skilled in the art will be able to envision various alternatives within the scope of my invention. Therefore, it is desired to limit my invention only within the lawful scope of the following claims.

I claim:

1. An apparatus for training baseball players to catch a ball hit on the ground, said apparatus comprising a relatively thin, rigid, and uniformly thick ball-impingement surface having a finger portion and a thumb portion generally in the shape of the outline of a baseball fielders' glove, said apparatus having means for attachment to one of the player's hands on the side opposite the ball-impingement surface.

2. A method for training a baseball player to catch a ball hit on the ground, said method comprising providing said player with an apparatus having a rigid, flat uniformly thick ball-impingement surface divided into a finger portion and a thumb portion generally in the shape of a baseball fielders' glove attachable to one of the player's hands and hitting a ground ball generally in the direction of the player, said player using said apparatus to stop the ball, trapping it against said ball-impingement surface with the free hand and grasping the ball for throwing to a teammate.

* * * * *